US009649858B2

(12) United States Patent
Suzuki

(10) Patent No.: US 9,649,858 B2
(45) **Date of Patent: *May 16, 2017**

(54) INKJET PRINTER HAVING TWO IONIZER THAT GENERATE ION OF OPPOSITE POLARITY

(71) Applicant: OKI Data Infotech Corporation, Chiba-shi, Chiba (JP)

(72) Inventor: Kazuo Suzuki, Chiba (JP)

(73) Assignee: OKI Data Infotech Corporation, Chiba-shi, Chiba (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/773,813

(22) PCT Filed: Apr. 30, 2014

(86) PCT No.: PCT/JP2014/061936
§ 371 (c)(1),
(2) Date: Sep. 9, 2015

(87) PCT Pub. No.: WO2014/203628
PCT Pub. Date: Dec. 24, 2014

(65) Prior Publication Data

US 2016/0129701 A1 May 12, 2016

(30) Foreign Application Priority Data

Jun. 20, 2013 (JP) ..... 2013-129662
Feb. 19, 2014 (JP) ..... 2014-029987

(51) Int. Cl.
*B41J 29/38* (2006.01)
*B41J 11/00* (2006.01)
(Continued)

(52) U.S. Cl.
CPC ..... *B41J 11/0015* (2013.01); *B41J 2/175* (2013.01); *B41J 29/13* (2013.01); *B41J 29/377* (2013.01)

(58) Field of Classification Search
CPC ..... B41J 11/0015; B41J 2/1714; B41J 2/175; B41J 29/377; B41J 29/13; B41J 13/009
See application file for complete search history.

(56) References Cited

U.S. PATENT DOCUMENTS 5,683,556 A 11/1997 Nomura et al.
8,845,066 B2 9/2014 Domae
(Continued)

FOREIGN PATENT DOCUMENTS

EP 2127754 A1 12/2009
JP 6246910 9/1994
(Continued)

OTHER PUBLICATIONS

International Search Report mailed Aug. 5, 2014, issued in International Application No. PCT/JP2014/061936.
(Continued)

*Primary Examiner* — Juanita D Jackson
(74) *Attorney, Agent, or Firm* — Muncy, Geissler, Olds & Lowe, P.C.

(57) ABSTRACT

In a printer in which an inkjet head is mounted in a carriage, which is movable in a direction intersecting with a conveyance direction of a recording medium, and ink is ejected from the inkjet head to record an image onto the recording medium, there has been a problem in that the recording medium is charged due to friction and separation at the time of conveyance of the recording medium, and ink mist is attracted to a portion charged to have an unexpected pattern to be recorded. In view of this problem, static electricity generated on the recording medium is removed by providing
(Continued)

the carriage with an ionizer for generating a positive ion and an ionizer for generating a negative ion and generating the ions at the time of scanning of the carriage. The static electricity can be removed efficiently by arranging on the carriage the ionizers for generating the ions of both polarities, namely, the positive ions and the negative ions.

5 Claims, 6 Drawing Sheets

(51) Int. Cl.

| | |
|---|---|
| ***B41J 2/175*** | (2006.01) |
| ***B41J 29/13*** | (2006.01) |
| ***B41J 29/377*** | (2006.01) |

(56) References Cited

U.S. PATENT DOCUMENTS

| | | | | |
|---|---|---|---|---|
| 9,446,596 | B2 * | 9/2016 | Suzuki | B41J 2/175 |
| 2005/0063130 | A1 | 3/2005 | Francis et al. | |
| 2009/0219663 | A1 | 9/2009 | Sato et al. | |
| 2010/0175391 | A1 | 7/2010 | Jee et al. | |
| 2013/0215194 | A1 * | 8/2013 | Leoni | B41J 2/1652 347/34 |

FOREIGN PATENT DOCUMENTS

| | | | |
|---|---|---|---|
| JP | 2009-016062 | A | 1/2009 |
| JP | 2012-179802 | A | 9/2012 |
| JP | 2013-119218 | A | 6/2013 |
| JP | 2013107330 | * | 6/2013 |
| JP | 2013107330 | A | 6/2013 |
| WO | WO9005441 | A1 | 5/1990 |
| WO | WO2006068290 | A2 | 6/2006 |
| WO | WO 2008054125 | A1 | 5/2008 |
| WO | WO2009067096 | A1 | 5/2009 |
| WO | WO2013039462 | A2 | 3/2013 |

OTHER PUBLICATIONS

Office Action issued on Jan. 10, 2017 in corresponding JP patent application No. 2014-029987.

Supplemental European Search Report mailed Feb. 10, 2017 in corresponding EP patent application No. EP 14 81 2927.

* cited by examiner

Fig.6

| TYPE OF RECORDING MEDIUM | FIRST PERIOD | SECOND PERIOD | THIRD PERIOD | FOURTH PERIOD |
|---|---|---|---|---|
| MEDIUM A | 0.7 | 0.8 | 0.9 | 1.0 |
| MEDIUM B | 0.4 | 0.6 | 0.8 | 1.0 |
| MEDIUM C | 0.6 | 0.75 | 0.9 | 1.0 |

INKJET PRINTER HAVING TWO IONIZER THAT GENERATE ION OF OPPOSITE POLARITY

TECHNICAL FIELD

The present invention relates to an inkjet printer.

BACKGROUND ART

There is known an inkjet printer for recording an image or the like by ejecting ink onto a recording medium, such as recording paper and a resin film. In the inkjet printer, an inkjet recording head is used in which a large number of nozzles are arranged on a nozzle surface, and ink is ejected from the nozzles to the recording medium, to thereby record a desired image.

A platen is arranged at a position opposed to the recording head. The recording medium is held on the platen in a planar manner, and the ink is ejected to the held recording medium. The recording medium is conveyed while being nipped by a conveyance roller and a pinch roller, which are arranged on an upstream side of the platen. In some cases, the recording medium is charged due to, for example, static electricity generated when the recording medium is separated from the rollers or static electricity generated by friction on the platen or another conveyance path.

Further, ink droplets ejected from the recording head may include not only ink droplets that account for the most part of the ejected ink, but also extremely small particles of scattered ink. Those extremely small particles of scattered ink may float as mist. When the recording medium is charged, this mist may be adhered in a concentrated manner to a portion charged, and the adhered mist may be recorded onto the recording medium to have an unexpected pattern. This pattern is a cause of deterioration of image quality.

For example, in JP 06-246910 A, there is disclosed a printer for printing an object to be printed while moving a printing head relative to the object to be printed, in which static electricity removing means is arranged on an upstream side of the direction in which the printing head and the object to be printed are configured to move relative to each other so as to remove electricity on the object to be printed.

CITATION LIST

Patent Literature

[PTL 1] JP 06-246910 A

SUMMARY OF INVENTION

Technical Problem

In the related-art printer, as the static electricity removing means, there is used an ion generator for generating an ion for electrically neutralizing the electricity charged on the object to be printed. The ion generator is arranged on the upstream side of the direction in which the printing head and the object to be printed are configured to move relative to each other, and after the electricity is neutralized on the upstream side, the printing is performed with the use of the printing head. Further, an AC corona discharge ionizer is used as the ion generator, and the generated positive and negative ions are blown out to the object to be printed together with air.

However, because the ion generator is the AC ionizer, a high AC voltage needs to be applied to a discharge needle, which necessitates a circuit for generating a high AC voltage. Moreover, when ON/OFF control is desired to be performed in order to adjust an amount of ions, a circuit scale is further increased, which necessitates a complicated circuit. This leads to a problem in that the size of a carriage is increased, and that the size of the apparatus is also increased.

Further, because the positive ion and the negative ion are generated by one electrode, the ions are more frequently recombined to each other, and the ions disappear more frequently before reaching the recording medium. The related-art printer is therefore low in efficiency of removing the static electricity.

In the related art, because there is also assumed a line printer having the printing head being fixed for use, a device for blowing out the air is also needed. When the device is mounted to the printing head, the printing head becomes heavier, resulting in an increase in size of the apparatus.

The related art has the above-mentioned problems.

Solution to Problem

According to one embodiment of the present invention, there is provided an inkjet printer for conveying a recording medium intermittently, ejecting ink from a recording head, and recording an image onto the recording medium, the inkjet printer including: the recording head for ejecting the ink to the recording medium from a plurality of nozzles; conveyance means for conveying the recording medium; a carriage having the recording head mounted therein, the carriage being reciprocable in a direction intersecting with a conveyance direction of the recording medium; a platen arranged so as to be opposed to a surface of the recording head on which the plurality of nozzles are arranged, for holding the recording medium being conveyed by the conveyance means; a housing having at least the platen and the carriage accommodated therein; a first ionizer for generating a positive ion; a second ionizer for generating a negative ion; a first drive circuit for driving the first ionizer; a second drive circuit for driving the second ionizer; and control means for controlling the first drive circuit and the second drive circuit, in which the first drive circuit and the second drive circuit are controlled by the control means independently of each other.

Advantageous Effects of Invention

According the one embodiment of the present invention, it is possible to reduce the sizes and weights of the ionizers and drive circuits mounted to the recording head, and hence it is possible to remove the static electricity of the recording medium efficiently. It is thus possible to record a high-quality image by recording the image onto the recording medium from which the static electricity is removed.

BRIEF DESCRIPTION OF DRAWINGS

FIG. 6 is a table for showing an irradiation rate corresponding to each type of recording medium.

DESCRIPTION OF EMBODIMENTS

An embodiment of the present invention is described with reference to the drawings.

Figure 1:
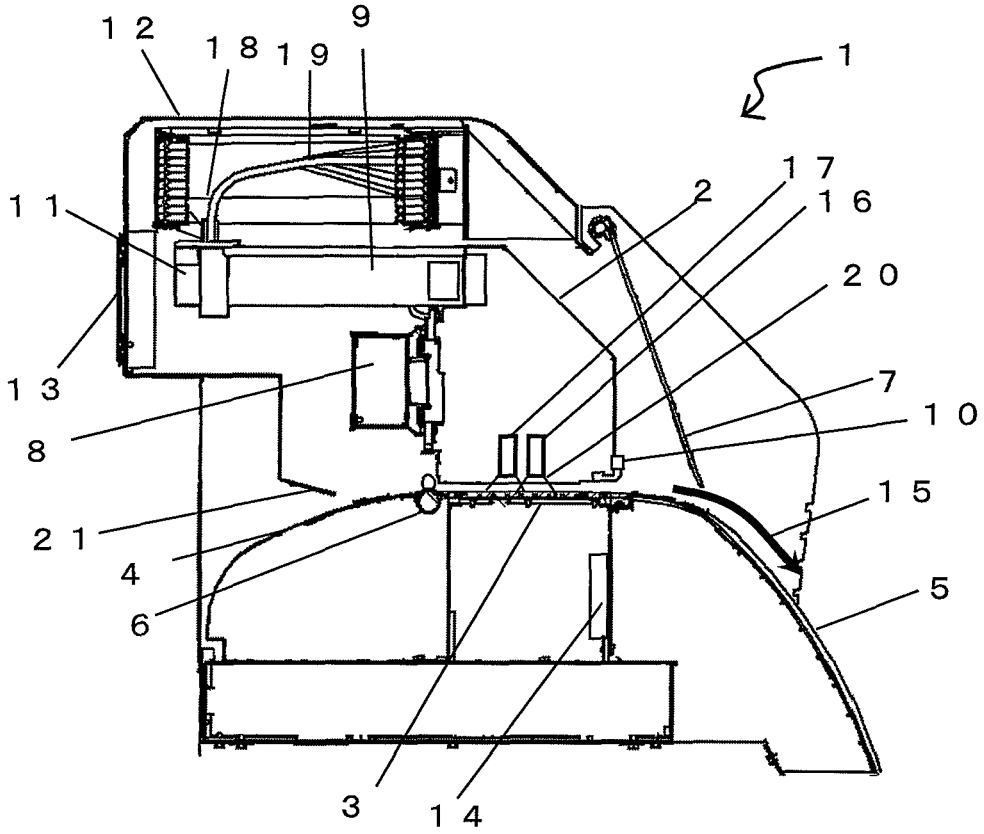
FIG. 1 is a cross-sectional view of an inkjet printer.

FIG. 1 is a cross-sectional view of an inkjet printer. In an inkjet printer 1, a carriage 2 having an inkjet-type recording head mounted therein reciprocates in a depth direction of the drawing sheet. The carriage 2 is movable along a rail 8. A platen 3 is arranged at a position opposed to a nozzle surface of the recording head. The platen 3 is formed of a flat plate, and a large number of through holes are formed in the platen 3. A sealed space is formed below the platen 3, and air is discharged from the sealed space by a suction fan 14. When the air is discharged, air pressure of the sealed space is decreased. The through holes are formed in the platen 3, and hence a recording medium arranged on the platen 3 is attracted thereonto. A large number of nozzles are formed in the nozzle surface of the recording head, and ink is ejected through the nozzles. The ink is ejected depending on a position of the carriage 2, thereby recording a desired image on the recording medium. When the ink is ejected, in addition to ejected droplets that account for the most part of the ejected ink, a slight amount of extremely small particles of ink is scattered. Those extremely small particles of ink float as mist in the air.

A front paper guide 5 is provided on a downstream side of the platen 3 along a conveyance direction of the recording medium, and a rear paper guide 4 is provided on an upstream side thereof. Conveyance rollers 6 are arranged in a portion between the rear paper guide 4 and the platen 3. The recording medium is heated in the rear paper guide 4, and conveyed while being nipped by the conveyance rollers 6 and pinch rollers paired with the conveyance rollers 6. Then, the recording medium is sent to the platen 3, and further delivered along the front paper guide 5. A heater is also provided in each of the platen 3 and the front paper guide 5 so as to heat the recording medium. In this manner, drying of ink adhered to the recording medium is promoted.

An upper portion of the rear paper guide 4 is opposed to a bending portion 21 corresponding to a portion at which an end portion of a housing 12 is bent. The bending portion 21 is bent toward an inward direction of the housing 12, and is closer to the rear paper guide 4 as approaching a distal end thereof. Further, the distal end portion of the bending portion 21 is arranged so as to be lower than a flat portion on a surface of the platen 3 in a vertical direction. With this, a gas sucked by housing-suction fans 13 arranged on a rear surface of the housing 12 easily flows, even in a small amount, toward the downstream side in the conveyance direction of the recording medium, that is, toward the carriage 2 or a cover 7. In other words, the sucked air is difficult to flow out through a portion between the bending portion 21 and the rear paper guide 4.

The front paper guide 5 is opposed to a distal end of the cover 7 provided above the front paper guide 5. Further, the cover 7 is closer to the front paper guide 5 as approaching a distal end thereof. The front paper guide 5 is curved downward as approaching the downstream side in the conveyance direction of the recording medium. With the cover 7 and the front paper guide 5 configured as described above, the gas inside the housing 12 easily flows along a surface of the front paper guide 5. The heater is arranged in a portion inside the front paper guide 5 on a rear surface side thereof, and the recording medium is heated by the heater, to thereby promote the drying of the ink adhered to the recording medium. In this case, when a solvent that evaporates in the vicinity of a surface of the recording medium stagnates, the drying of the ink is inhibited. Therefore, the stagnation of the solvent is prevented by sending air. The cover 7 is arranged closer to the front paper guide 5 so as to form an air-flow along the front paper guide 5 in a direction indicated by the arrow 15, and is arranged so as to be oriented downward.

A duct 9 is arranged above the carriage 2 so as to extend toward a rear surface of the housing 12. A carriage-suction fan 11 is arranged at an end portion of the duct 9 on a rear surface side of the housing 12. The housing-suction fans 13 and the carriage-suction fan 11 are arranged so as to be opposed to each other.

The duct 9 is arranged at each end in a moving direction of the carriage 2. The carriage-suction fan 11, which serves as carriage-suction means for sucking the gas into the carriage 2, is arranged at a distal end of each duct 9. The gas is sucked by the carriage-suction fan 11, and passes through the duct 9 and an inside of the carriage 2. Then, the gas is discharged to an outside through an exhaust port 10 formed in a lower portion of the carriage 2 on the downstream side of the conveyance direction of the recording medium, that is, discharged into the housing 12. The exhaust port 10 is directed to the cover 7, and the discharged gas flows toward the cover 7. The inside of the carriage 2 and a recording head 2 are cooled by the gas flowing inside the carriage 2. The exhaust port 10 is formed into an elongated hole along the moving direction of the carriage 2, that is, along a widthwise direction thereof. It is preferred to form an elongated hole having a width corresponding to arrangement of the recording head of the carriage 2. With this, the gas less easily stagnates in the carriage 2 to facilitate the discharge of the gas.

In a portion above the duct 9, a flat cable 18 and an ink tube 19 are arranged so as to be routed around this portion. The flat cable 18 and the ink tube 19 are respectively connected to an electric circuit and an ink tank, which are provided outside the carriage 2.

Each housing-suction fan 13 has a height larger than a height of the carriage-suction fan 11, which is twice as large as the height of the carriage-suction fan 11. In other words, as the housing-suction fan 13, a large-sized fan is used so as to suck a large amount of the outside air. The gas sucked into the housing 12 includes a gas that is sucked into the carriage 2 by the carriage-suction fan 11 and a gas that passes through the outside of the carriage 2. The sucked air is directed toward the cover 14 arranged on a front surface of the housing 12. The housing-suction fan 13 is prevented from being blocked by the carriage-suction fan 11, thereby being capable of reducing a sharp change in direction of the air-flow. An upper end of the cover 7 is connected to the housing 12 in a pivotable manner.

Further, the gas discharged from the exhaust port 10 is directed to the cover 7. The cover 7 is inclined, and hence the gas blown onto the cover 7 forms an air-flow along the cover 7 in a downward direction, and further flows along the front paper guide 5. The gas exhausted from the exhaust port 10 is discharged to the outside while being mixed with a gas flowing through the outside of the carriage 2. The gas sucked by the carriage-suction fans 11 flows faster than the gas flowing through the outside of the carriage 2 when discharged from the discharge port 10. Along with the air-flow from the discharge port 10, a gas surrounding the air-flow also flows faster, and hence the gas can be smoothly discharged from a portion between the front paper guide 5 and the cover 7 to the outside. It is possible to promote the discharge of the solvent having evaporated into the gas from the ink stagnating in the housing 12, and hence the ink can be dried in a shorter period of time.

A first ionizer 16 for generating a positive ion and a second ionizer 17 for generating a negative ion are arranged on a side surface of the carriage 2. The first ionizer 16 and the second ionizer 17 each have an opening in a downward direction, namely, in a direction toward the platen 3, and the ions are discharged from those openings. The ions are discharged in an irradiation direction 20 of the ions. The ions discharged from the first ionizer 16 and the second ionizer 17 remove the static electricity of the recording medium. The first ionizer 16 and the second ionizer 17 are arranged at a little distance from each other along the conveyance method direction of the recording medium. The discharged ions are stirred by the air-flow within the housing 12, but a part of the discharged ions reaches the recording medium to remove the electricity charged on the recording medium.

At the time of recording, the recording medium is conveyed by a distance obtained by dividing a length of the recording head by an integer of two or more, and the recording is performed on the same area a plurality of times. For example, the printing is performed in divided parts about four to twelve times. In a printer using such a recording method, even without the use of an ionizer having a width that covers the entire width of the platen 3, the electricity charged on the recording medium can be removed with the use of the ionizer for discharging the ion within a narrow range. Further, by supplying the ions from the ionizer to the same area the plurality of times, the electricity is removed more securely.

Further, by generating the positive ion and the negative ion with the use of separate electrodes, the positive ion and the negative ion are recombined to each other less frequently so that the number of ions to reach the recording medium can be increased. It is preferred that a distance between the first ionizer 16 and the second ionizer 17 be about from 5 mm to 20 mm. When the first ionizer 16 and the second ionizer 17 are separated from each other too much, namely, separated from each other by an amount corresponding to a single conveyance of the recording medium, both of the positive ion and the negative ion cannot be supplied to the same area by a single scanning of the carriage 2, and only one of the positive ion and the negative ion is supplied to the same area as a result. Thus, the balance between a concentration of the positive ions and a concentration of the negative ions is lost, and hence the charged electricity can no longer be removed suitably as a result. Further, by arranging the first ionizer 16 and the second ionizer 17 close to the recording medium, specifically, by setting a distance from the first ionizer 16 or the second ionizer 17 to the recording medium to from 10 mm to 30 mm, the ions are prevented from being scattered in other directions than a direction toward the recording medium. 4Moreover, it is also possible to inhibit the recombination of the ions. When the first ionizer 16 and the second ionizer 17 are separated from the recording medium too much, the ions are diffused before reaching the recording medium, and hence the charged electricity cannot be removed. When the first ionizer 16 and the second ionizer 17 are close to the recording medium too much, both of the positive ion and the negative ion cannot be supplied to the same area, and only one of the positive ion and the negative ion is supplied to the same area as a result. Thus, the balance between a concentration of the positive ions and a concentration of the negative ions is lost, and hence the charged electricity can no longer be removed suitably as a result.

Figure 2:
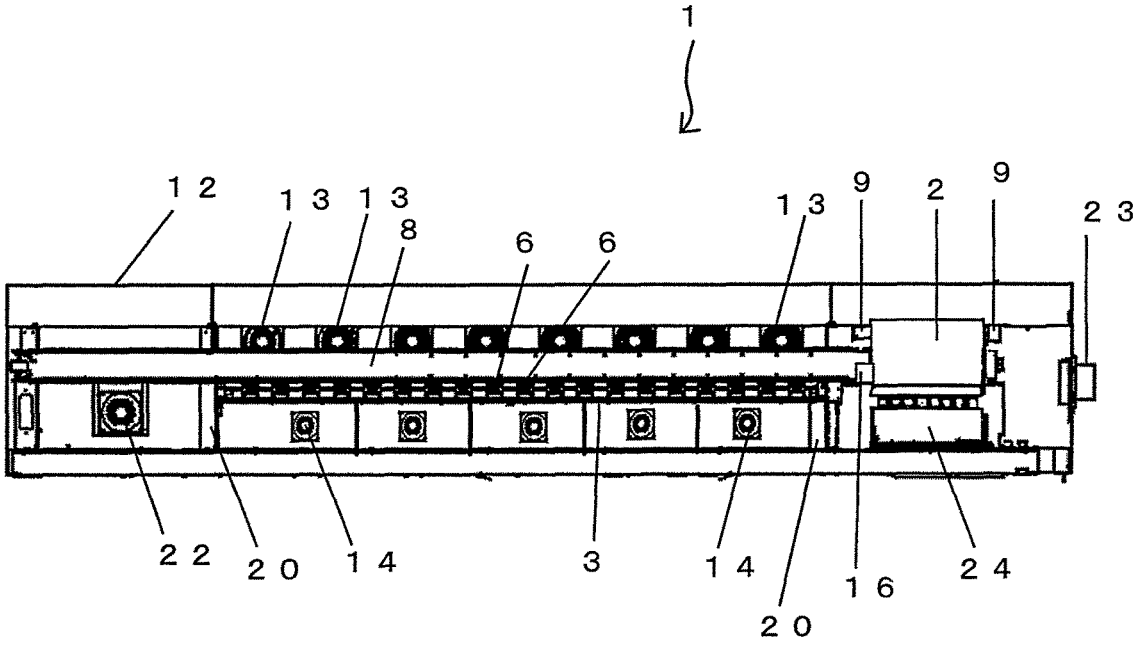
FIG. 2 is an explanatory view of arrangement of suction means and exhaust means in the inkjet printer.

FIG. 2 is an explanatory view of arrangement of suction means and exhaust means in the inkjet printer. A flow of the air in the housing 12 is described with reference to FIG. 2. The gas sucked into the housing 12 is discharged from a housing side surface-exhaust fan 23, a housing rear surface-exhaust fan 22, a portion between the rear paper guide 4 and the bending portion 21, or a portion between the front paper guide 5 and the cover 7, or through the suction by the platen 3. A large number of the housing-suction fans 13 serving as housing-suction means for sucking the gas are arranged on the rear surface of the housing 12 of the inkjet printer 1. The housing-suction fans 13 are arranged along a longitudinal direction of the housing 12. The housing-suction fans 13 are arranged so as to be opposed to the carriage-suction fan 11. This configuration is made to enable sucking a large amount of the air present outside the housing 12 into the carriage 2.

The rail 8 and the platen 3 are also arranged along the longitudinal direction of the housing. The platen 3 is a flat platen, and the large number of through holes are formed in the platen 3. Below the platen 3, there is secured a space partitioned by the platen 3, erecting plates 20 provided below both ends of the platen 3, and the like. A gas in the space is discharged to the outside through the suction fans 14 so as to generate negative pressure, and the recording medium conveyed on the platen 3 is sucked so as to be supported.

The air flows in the following route. Specifically, the air flows from the housing-suction fans 13 toward the cover 7, and flows downward along the cover 7 to be discharged to the outside through the gap between the front paper guide 5 and the cover 7.

A large number of the conveyance rollers 6 for conveying the recording medium are provided on the upstream side of the platen 3 along the conveyance direction of the recording medium. The conveyance rollers 6 are arranged along a longitudinal direction of the platen 3 at equal intervals. A maintenance unit 24 for the recording heads is provided on one end of the housing 12. The maintenance unit 24 includes a wiper for wiping the nozzle surface of the recording head, and a cap for sucking ink while being held in close contact with the nozzle surface. The housing side surface-exhaust fan 23 is provided on a side surface of the housing 12 on the maintenance unit 24 side so as to exhaust the gas inside the housing 12 to the outside. Further, a space for turning when the carriage 2 reciprocates is secured on a side of the housing 12, which is opposite to the housing side surface-exhaust fan 23 across the platen 3. The housing rear surface-exhaust fan 22 is provided on the rear of the space, that is, the rear surface of the housing 12 so as to exhaust the gas inside the housing 12 to the outside. In this manner, the air is exhausted by the fans, thereby being capable of reducing an amount of the air discharged through the portion between the cover 7 and the front paper guide 5. As a result, cooling of the recording medium can be suppressed in some degree. Further, the air-flow within the housing 12 also stirs the ions generated by the first ionizer 16 and the second ionizer 17 so that the ions impinge on the recording medium.

Figure 3:
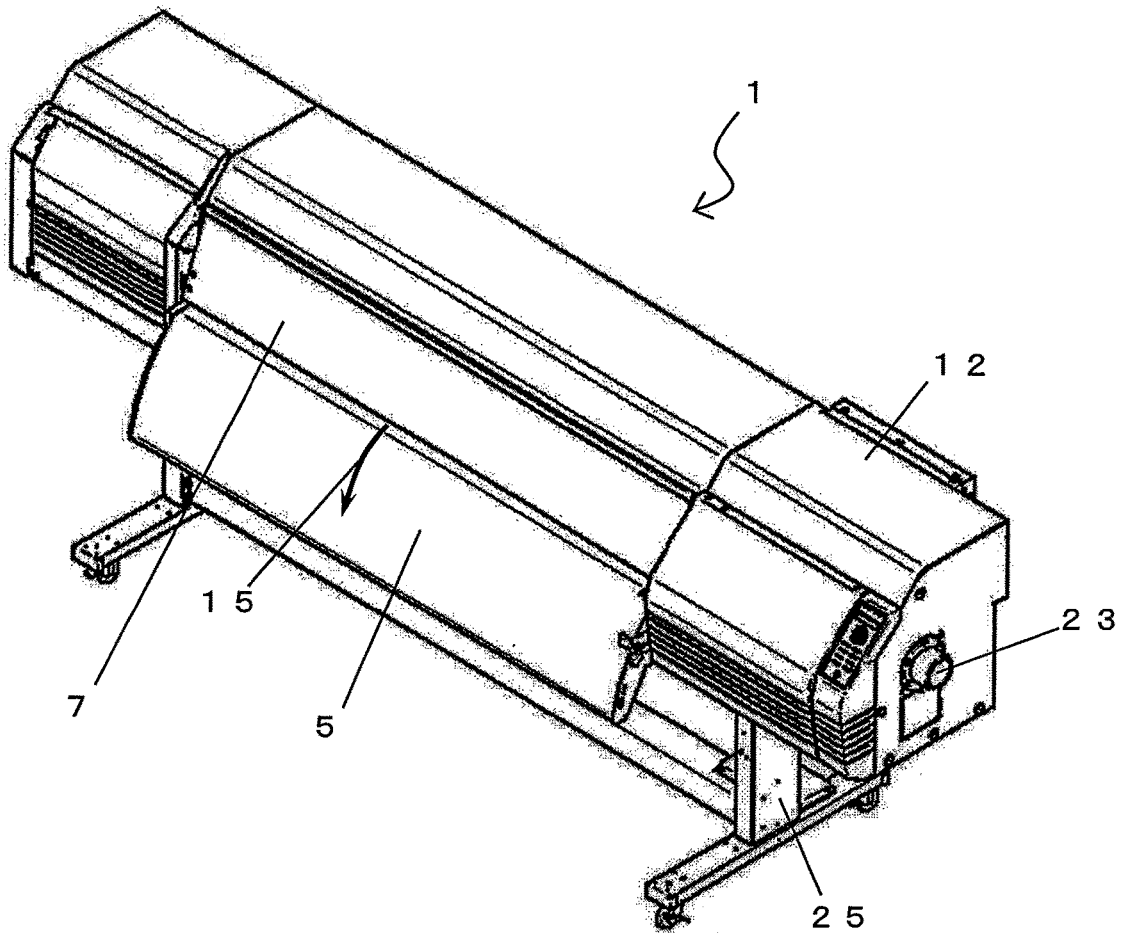
FIG. 3 is an external view of the inkjet printer.

FIG. 3 is an external view of the inkjet printer. In the inkjet printer 1, the housing 12 is supported by legs 25. The legs 25 are fixed to ends of a lower surface of the housing 12.

Figure 4:
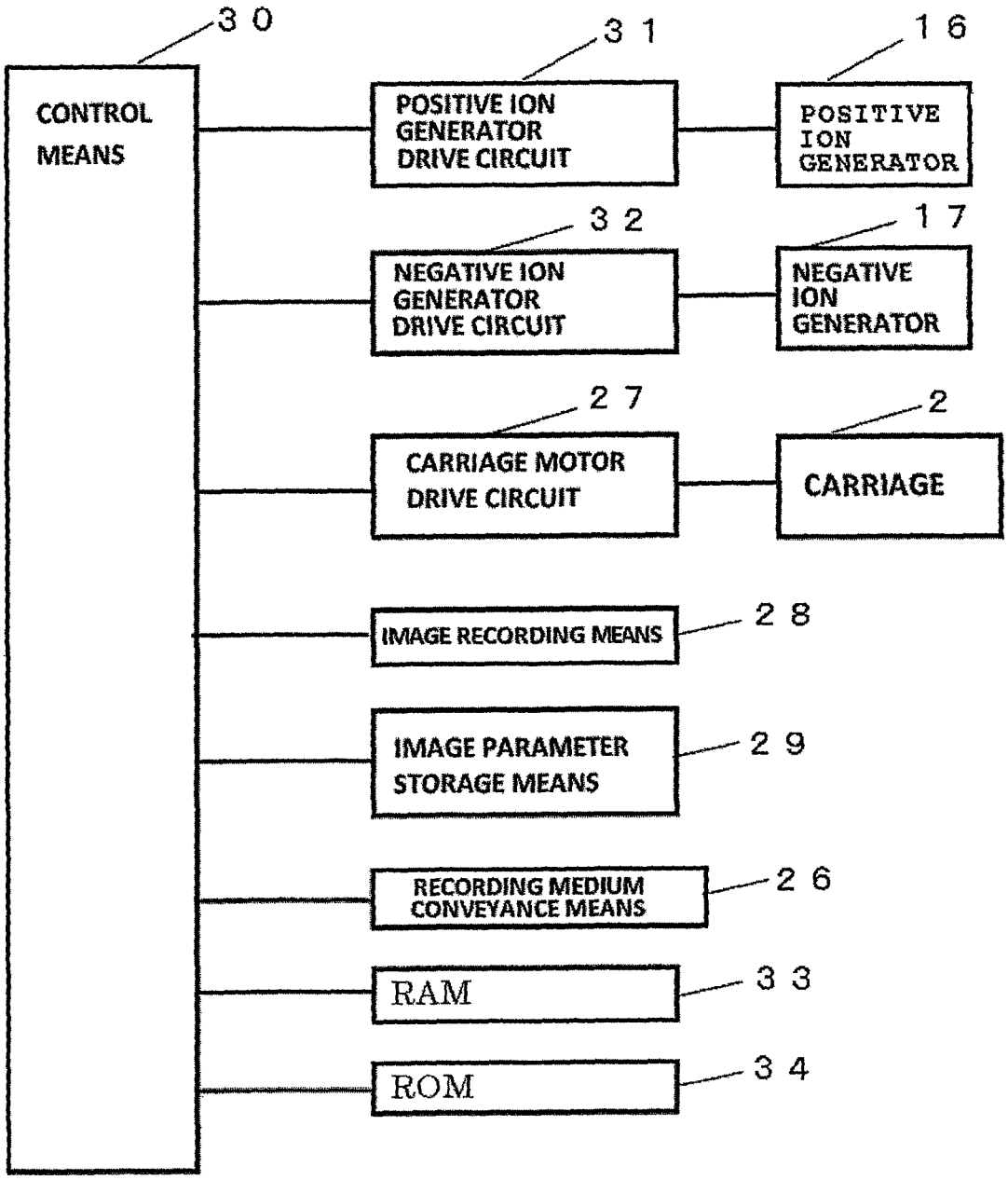
FIG. 4 is a block diagram of the inkjet printer.

FIG. 4 is a block diagram of the inkjet printer. Control means 30 performs overall control in accordance with a program stored in a ROM 34. The ROM 34 is a non-volatile memory for storing the program, an initial setting value, and the like. A RAM 33 is a RAM to function as a work area of the control means 30 and temporally store information, for example.

A positive ion generator drive circuit 31 drives a positive ion generator, namely, the first ionizer 16 based on the control of the control means 30. A negative ion generator drive circuit 32 drives a negative ion generator, namely, the second ionizer 17 based on the control of the control means 30. A carriage motor drive circuit 27 is a motor drive circuit for moving the carriage 2, and operates based on the control of the control means 30. A DC ionizer and a DC drive circuit, which are easy to be controlled, are particularly preferred.

Recording medium conveyance means 26 is driven based on the control of the control means 30. The recording medium conveyance means 26 is means including the conveyance roller 6 and a motor for driving the conveyance roller 6, for conveying the recording medium. The amount of a single conveyance of the recording medium is determined based on the number of passes at the time of recording, which is stored in image parameter storage means 29.

The image parameter storage means 29 stores, for each recording mode, data necessary at the time of image recording, such as the number of recording passes, a setting value as to whether or not to turn the first ionizer 16 and the second ionizer 17 on or off, and the control means 30 operates based on the data and program.

Image recording means 28 includes an inkjet recording head and a drive circuit therefor, and operates based on the control of the control means 30.

The first ionizer 16 and the second ionizer 17 operate under the control of the control means 30, and are controlled independently of each other. Further, the first ionizer 16 and the second ionizer 17 are controlled in a manner that corresponds to the operation of the recording medium conveyance means 26. The first ionizer 16 and the second ionizer 17 are controlled so that the positive ion and the negative ion can be supplied to the recording medium as evenly as possible. The first ionizer 16 and the second ionizer 17 may be controlled so that one of the ionizers is turned on while the other is turned off, and the amount of ions to be discharged from each of the ionizers can be easily controlled as necessary.

Figure 5:
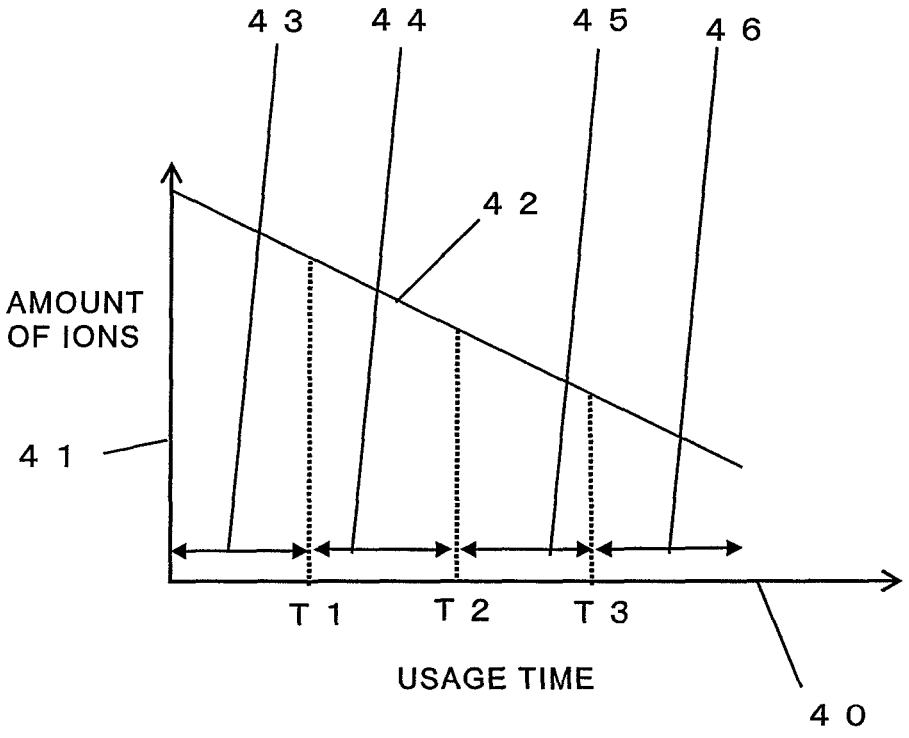
FIG. 5 is a graph for showing deterioration of an ionizer.

FIG. 5 is a graph for showing deterioration of the ionizer. FIG. 5 is a graph in which an X-axis represents a usage time 40 of one of the first ionizer 16 and the second ionizer 17 and a Y-axis represents an amount of ions 41 generated from the ionizer. As indicated by a line 42, the first ionizer 16 and the second ionizer 17 each have such a characteristic that as the usage time of the ionizer becomes longer, the amount of ions generated from the ionizer decreases. A usage time that has elapsed since the start of use until T1 is defined as a first period 43, a period from T1 to T2 is defined as a second period 44, a period from T2 to T3 is defined as a third period 45, and a period after T3 is defined as a fourth period 46. Each of the first ionizer 16 and the second ionizer 17 is set so as to reach its usage limit at around T3. For example, when T3 is to be determined, time when the ionizer has deteriorated by a predetermined degree of deterioration, such as 50%, may be set as the usage limit. Further, the usage limit maybe determined depending on the recording medium to be used. When the usage time passes T3, the ionizer generates a smaller number of ions and the efficient deteriorates, and hence it is preferred not to use the ionizer any longer. Further, in the fourth period, the ionizer may be used continuously without an end of its operation being determined. However, in that case, the ionizer is used with recognition of a possibility that because the amount of generated ions is small, the ion can no longer be applied as intended and thus intended performance cannot be exerted. When the ionizer is used in such a manner, it is preferred that a notification function such as displaying an alert on a display be provided.

Further, the ionizer for generating the positive ion and the ionizer for generating the negative ion may not have the same relationship between the usage time and the amount of generated ions, and hence it is preferred that in consideration of the characteristic of each of the ionizers, each of the ionizers be controlled with a period corresponding to the degree of deterioration being determined. Further, in the above-mentioned example, the ionizers are controlled with the periods being determined, but a function of the usage time and the degree of deterioration may be acquired in advance so that an irradiation rate is controlled based on the degree of deterioration, which is determined based on an actually measured usage time and the function. In this manner, it is possible to apply the ions more accurately.

FIG. 6 is a table for showing the irradiation rate corresponding to each type of recording medium. When the ion is applied to the recording medium, an optimum irradiation amount varies depending on the type of recording medium to be used. In order to maintain this optimum irradiation amount, it is necessary to take into consideration the amount of ions generated from each of the first ionizer 16 and the second ionizer 17, which decreases as the usage time of the ionizer passes. For example, a relationship between the type of recording medium and the irradiation rate of ions that is determined depending on the usage time is stored in the ROM 34 as a table, and such control is performed that when the type of recording medium is input, the corresponding irradiation rate can be calculated. This control can be realized by the control means 30 counting the usage time of each of the first ionizer 16 and the second ionizer 17.

In the table shown in FIG. 6, a medium A has irradiation rates of 0.7, 0.8, 0.9, and 1.0 in the first period 43, the second period 44, the third period 45, and the fourth period 46, respectively. This value is a value proportional to an irradiation amount. For example, when the value of the irradiation rate is 0.7, this value indicates an irradiation amount of 70%, and when the value of the irradiation rate is 0.8, this value indicates an irradiation amount of 80%. When the value of the irradiation rate is 1.0, this value indicates an irradiation amount of 100%. This irradiation amount may be controlled depending on the length of time of irradiation. A medium B has irradiation rates of 0.4, 0.6, 0.8, and 1.0 in the first period 43, the second period 44, the third period 45, and the fourth period 46, respectively. A medium C has irradiation rates of 0.6, 0.75, 0.9, and 1.0 in the first period 43, the second period 44, the third period 45, and the fourth period 46, respectively.

The control means 30 includes input means and time measurement means, to thereby individually measure the usage time of each of the first ionizer 16 and the second ionizer 17. Moreover, the control means 30 stores in advance the table associating the usage time with the irradiation rate for each recording medium. Through the use of the type of recording medium input from the input means and the usage time of the ionizer and based on the table, the control means 30 calculates the irradiation rate corresponding to the input recording medium. Then, the control means 30 controls the ion irradiation based on the thus calculated irradiation rate.

The table is determined in advance so that the irradiation rate is optimum for each combination of the type of recording medium and the usage time. It is possible to facilitate control such as calculation processing by storing the table and calculating the irradiation rate based on the stored table. Further, instead of using the table, the control means 30 may store a function so as to alternatively perform processing of calculating the degree of deterioration and the irradiation rate based on the usage time. More accurate control is performed with this configuration, but a calculation amount may increase.

Further, it is preferred that when the usage time reaches the fourth period 46, namely, the usage time exceeds T3, an alert for prompting replacement of the first ionizer 16 and the second ionizer 17 be issued. This is because although the ionizer at least operates even when applying the ions continuously at the irradiation rate of 100%, the effect of irradiation may be insufficient because the amount of generated ions is small.

INDUSTRIAL APPLICABILITY

The present invention is applicable to an inkjet printer.

REFERENCE SIGNS LIST

1 inkjet printer
2 carriage
3 platen
4 rear paper guide
5 front paper guide
6 conveyance roller
7 cover
8 rail
9 duct
10 exhaust port
11 carriage-suction fan
12 housing
13 housing-suction fan 13
14 suction fan
16 first ionizer
17 second ionizer
22 housing rear surface-exhaust fan
23 housing side surface-exhaust fan
24 maintenance unit

The invention claimed is:

1. An inkjet printer for conveying a recording medium intermittently, ejecting ink from a recording head, and recording an image onto the recording medium, the inkjet printer comprising:

the recording head for ejecting the ink to the recording medium from a plurality of nozzles;

conveyance means for conveying the recording medium;

a carriage having the recording head mounted therein, the carriage being reciprocable in a direction intersecting with a conveyance direction of the recording medium;

a platen arranged so as to be opposed to a surface of the recording head on which the plurality of nozzles are arranged, for holding the recording medium being conveyed by the conveyance means;

a housing having at least the platen and the carriage accommodated therein;

a first ionizer for generating a positive ion;

a second ionizer for generating a negative ion;

a first drive circuit for driving the first ionizer;

a second drive circuit for driving the second ionizer;

control means for controlling the first drive circuit and the second drive circuit;

housing-suction means arranged on a rear surface side of the housing, for sucking a gas from an outside to an inside of the housing;

a front paper guide provided on a downstream side of the platen in the conveyance direction, for guiding the recording medium onto which the image has been recorded; and a cover arranged so that a distal end thereof is located at a distance from the front paper guide, the distal end being located lower in a vertical direction than the surface of the recording head on which the plurality of nozzles are arranged, the cover being connected to the housing so as to be rotatable, wherein the first drive circuit and the second drive circuit are controlled by the control means independently of each other, wherein the cover is arranged so as to approach the front paper guide toward the distal end, wherein a portion of the front paper guide on the downstream side in the conveyance direction of the recording medium is curved in the vertical direction, and wherein a part of the gas sucked by the housing-suction means is discharged from a portion between the front paper guide and the cover.

2. An inkjet printer according to claim 1, wherein on a side surface of the carriage being reciprocable in a moving direction of the carriage, the first ionizer and the second ionizer are arranged at a distance from each other along the conveyance direction of the recording medium, and the first ionizer and the second ionizer have openings from which ions are to be discharged, the openings being formed so as to face toward the platen side.

3. An inkjet printer according to claim 1, wherein the carriage comprises:

a duct arranged to protrude toward the housing-suction means, the duct comprising carriage-suction means for sucking, into the carriage, the gas sucked by the housing-suction means, the carriage-suction means being arranged at a distal end of the protruding portion of the duct so as to be opposed to the housing-suction means; and an exhaust port with an elongated hole shape formed along the moving direction in a lower portion of a front surface of the carriage on the downstream side in the conveyance direction, wherein the gas sucked by the housing-suction means is separated into the gas flowing inside the carriage through the carriage-suction means, and the gas flowing outside the carriage, and wherein the gas discharged through the exhaust port is discharged toward the cover, and also discharged to an outside of the housing while mixed with the gas flowing outside the carriage.

4. An inkjet printer for conveying a recording medium intermittently, ejecting ink from a recording head, and recording an image onto the recording medium, the inkjet printer comprising:

the recording head for ejecting the ink to the recording medium from plurality of nozzles;

conveyance means for conveying the recording medium;

a carriage having the recording head mounted therein, the carriage being reciprocable in a direction intersecting with a conveyance direction of the recording medium;

a platen arranged so as to be opposed to a surface of the recording head on which the plurality of nozzles are arranged, for holding the recording medium being conveyed by the conveyance means;

a housing having at least the platen and the carriage accommodated therein;

a first ionizer for generating a positive ion;

a second ionizer for generating a negative ion;

a first drive circuit for driving the first ionizer;

a second drive circuit for driving the second ionizer; and control means for controlling the first drive circuit and the second drive circuit, wherein the first drive circuit and the second drive circuit are controlled by the control means independently of each other, wherein the control means comprises measurement means for measuring a usage time of each of the first ionizer and the second ionizer, wherein the control means stores, in advance, the usage time and an amount of ions generated from the first ionizer in association with each other and stores, in advance, the usage time and an amount of ions generated from the second ionizer in association with each other, and wherein depending on the usage times, the control means generates the ions from the first ionizer and the second ionizer and controls an amount of ions to be applied to the recording medium.

5. An inkjet printer for conveying a recording medium intermittently, ejecting ink from a recording head, and recording an image onto the recording medium, the inkjet printer comprising:

the recording head for ejecting the ink to the recording medium from a plurality of nozzles;

conveyance means for conveying the recording medium;

a carriage having the recording head mounted therein, the carriage being reciprocable in a direction intersecting with a conveyance direction of the recording medium;

a platen arranged so as to be opposed to a surface of the recording head on which the plurality of nozzles are arranged, for holding the recording medium being conveyed by the conveyance means;

a housing having at least the platen and the carriage accommodated therein;

a first ionizer for generating positive ion;

a second ionizer for generating a negative ion;

a first drive circuit for driving the first ionizer;

a second drive circuit for driving the second ionizer;

control means for controlling the first drive circuit and the second drive circuit; and input means for inputting a type of the recording medium to be used, wherein the first drive circuit and the second drive circuit are controlled by the control means independently of each other, wherein the control means stores, in advance, the type of the recording medium and an amount of ions generated from the first ionizer in association with each other and stores, in advance, the type of the recording medium and an amount of ions generated from the second ionizer in association with each other, and wherein depending on the type of the recording medium input from the input means, the control means generates the ions from the first ionizer and the second ionizer and controls an amount of ions to be applied to the recording medium.

* * * * *